United States Patent [19]

Paul

[11] Patent Number: 4,834,544

[45] Date of Patent: May 30, 1989

[54] FINES SEPARATION SYSTEM FOR PELLET BLENDER

[75] Inventor: Kermit D. Paul, Bethlehem, Pa.

[73] Assignee: Fuller Company, Bethlehem, Pa.

[21] Appl. No.: 70,282

[22] Filed: Jul. 6, 1987

[51] Int. Cl.[4] ..... B01F 13/02; B01F 15/02; B07B 7/00

[52] U.S. Cl. ..... 366/101; 366/341; 209/142; 209/154; 406/142; 406/163; 406/174

[58] Field of Search ..... 209/138, 139.1, 140, 209/142, 143, 146, 147, 150, 154; 366/101, 106, 107, 191, 341; 406/141-143, 163, 174

[56] References Cited

U.S. PATENT DOCUMENTS

| | | | |
|---|---|---|---|
| 233,847 | 11/1880 | Groom | 209/142 X |
| 431,313 | 7/1890 | Ballard | 209/139.1 |
| 459,570 | 9/1891 | Beynon | 209/139.1 |
| 940,469 | 11/1909 | Middleton | 209/138 |
| 1,953,058 | 4/1934 | Andrews et al. | 209/143 |
| 2,330,793 | 9/1943 | Peebles | 209/139.1 |
| 2,638,217 | 5/1953 | Niemitz | 209/139.1 |
| 2,909,392 | 10/1959 | Rees et al. | 406/142 |
| 3,295,677 | 1/1967 | Condolios | 209/138 X |
| 3,386,707 | 6/1968 | Brown | 366/107 |
| 3,807,705 | 4/1974 | Humkey et al. | 366/101 |
| 4,542,991 | 9/1985 | Krauss et al. | 366/106 |

FOREIGN PATENT DOCUMENTS

| | | | |
|---|---|---|---|
| 0898109 | 11/1953 | Fed. Rep. of Germany | 366/101 |
| 1905106 | 8/1970 | Fed. Rep. of Germany | 209/143 |
| 0350932 | 6/1931 | United Kingdom | 209/142 |

*Primary Examiner*—Johnny D. Cherry
*Assistant Examiner*—Edward M. Wacyra
*Attorney, Agent, or Firm*—Stevens, Davis, Miller & Mosher

[57] ABSTRACT

A blender for solid particulate material such as plastic pellets which includes an apparatus for separating a fine fraction of material from the plastic pellets. This is accomplished by a separator shell which surrounds a vertical lift pipe in the blender. Gas under pressure is utilized to circulate material through the lift pipe from the bottom of the vessel to the top of the vessel to blend the material. As material is discharged from the vertical lift pipe, the air supplied through the lift pipe for lifting material flows through material dispersed within the separation zone to entrain the fine material and convey it through a vent to a high efficiency dust collector. A by-pass conduit and by-pass control valve are provided to control the velocity of gas through the separation zone to control the size particle of the fine fraction which is separated.

6 Claims, 1 Drawing Sheet

FINES SEPARATION SYSTEM FOR PELLET BLENDER

BACKGROUND OF THE INVENTION

This invention relates to apparatus for blending solid particulate material such as plastic pellets and in particular to a fines separations system for such a pellet blender.

Prior to the present invention, various apparatus have been utilized for blending or mixing pelletized materials such as plastic pellets. This apparatus may consist of generally vertically oriented vessels adapted to be at least partially filled with particulate material. In order to blend the material, the material is withdrawn from various levels in the vessel to a common point through vertical downcomers. In some instances, the material is recirculated back into the top of vessel to achieve the blending or mixing while in other cases the material is withdrawn from the various levels in vessels for direct discharge from the vessel to a use point.

In some instances such as illustrated in U. S. Pat. No. 4,569,596 issued Feb. 11, 1986, and in U. S. Pat. application, Ser. No. 06/848,005 filed Apr. 3, 1986, there is a central lift column with gaseous fluid under pressure supplied to the lower inlet of the lift column to entrain material and lift it up through the column to its outlet where it cascades in a geyser-like manner into the top of the vessel to thereby blend the material within the vessel.

Material to be blended is often supplied to the vessel by pneumatic conveying means. Typically, this is done by supplying the material to the top of the vessel, but in some instances such as illustrated in the aforesaid U. S. Pat. No. 4,569,596, the material may be supplied to the bottom of the vessel for direct passage up through the lift column. This system utilizes the conveying air as the blending energy.

It is generally known that a quantity of plastic pellets may contain a fine fraction of material which is smaller than the desired pellets. For example, a typical desired pellet may have a length by diameter of $\frac{1}{8}$ by $\frac{1}{8}$ and anything smaller than the specified size would be considered a fine fraction and not a usable product.

In some instances some pellets may have a particle size within the desired range but during the production process there is an occurance which results in a particle that is less dense or lighter in weight than the desired product. Having a quantity of less dense pellets may be the result of operating the extruder at a high production rate.

As used in this specification, 'fine fraction' encompasses both the less dense pellets or particles and the smaller particle size. It would be desirable to eliminate this fine fraction.

It is known prior to the present invention that if gaseous fluid is disbursed through a quantity of pelletized material contained within a vessel, the gaseous fluid will entrain the fine fraction and this fine fraction can be discharged from the vessel through the vent of the vessel to a dust collection apparatus. However, in most instances, a high pressure drop is encountered in the cleaning process and a satisfactory result may not be obtained. The fines cleaning process is broadly described in the aforementioned U. S. Pat. No. 4,569,596.

It would be desirable to utilize the energy which is used for blending the particulate material or pellets to serve as a means for separating the fine material from the quantity of desired sized pellets. It would also be desirable if the energy utilized to supply the particulate material to the blender or vessel could also be utilized in cleaning the pellets by removing the fine fraction of material. If the pellets can be cleaned by removing the fine fraction during the supply process, then there will not be a build-up of fine material within the vessel.

During the course of manufacture and use of pelletized material it is sometimes desirable to manufacture one size pellets and then at some time manufacture a different size pellet. Since the same blender/storage vessel may be utilized for different sized pellets, it would be desirable to have an apparatus which allows adjustment of the split between the fine fraction to be removed and the coarse fraction to be retained.

SUMMARY

It is therefore the principal object of this invention to provide a fines separation system for use with a vessel for particulate material which utilizes the energy for supplying material to the vessel and/or for circulating material through the vessel for removing a fine fraction of material from the material.

It is another object of this invention to provide an apparatus for separating a fine fraction of material from solid particulate material within a vessel which includes passing a gaseous fluid through the particulate material at a velocity sufficient to entrain and remove from the vessel the largest desired particles of the fine fraction to be separated while being insufficient to entrain the smallest desired size of particulate material to be retained in the vessel.

It is a still further object of this invention to provide a fines separation system which includes a means for controlling the size of the fine fraction which is to be separated from the particulate material.

The foregoing and other objects of the invention will be carried out by providing in a vessel for solid particulate material including a vertically oriented lift pipe for circulating material within the vessel having an inlet near the bottom of the vessel and an outlet near its top and means for supplying gaseous fluid to the inlet of the lift pipe for entraining and conveying material in the vessel into the inlet of the lift pipe through the lift pipe to the outlet of the lift pipe for discharge back into the vessel to thereby circulate material through the vessel, and means defining a vent for venting gaseous fluid from the vessel, apparatus for separating a fine fraction of material from the solid particulate material comprising: means defining a separator shell surrounding the outlet of the lift pipe and defining a separation zone whereby material discharged through the outlet of the lift pipe cascades through the separation zone into the top of the vessel; said separator shell being flow connected to the means defining a vent whereby gaseous fluid to be vented from said vessel flows through the material discharged from the lift pipe in said separation zone to said vent for separating a fine fraction of material from the lift pipe and entraining and conveying said fine fraction through the vent out of the vessel; said separation zone being dimensioned so that the velocity of gaseous fluid flowing through the separation zone is sufficient to entrain and convey of the fine fraction to be separated while being insufficient to entrain the particulate material to be retained in said vessel.

The invention also includes a by-pass conduit for selectively by-passing some of the vent gas around the separation zone including a flow control valve in the by-pass conduit. In this manner, the velocity of gas flowing through the separation zone can be adjusted. This permits a control over the size of the fine fraction removed from the material.

In addition to recirculated material flowing through the separation zone, new feed is passed through the separation zone to provide an initial cleaning of the material.

BRIEF DESCRIPTION OF THE DRAWING

The invention will be described in connection with the annexed drawing wherein.

DESCRIPTION OF THE PREFERRED EMBODIMENT

Figure 1:
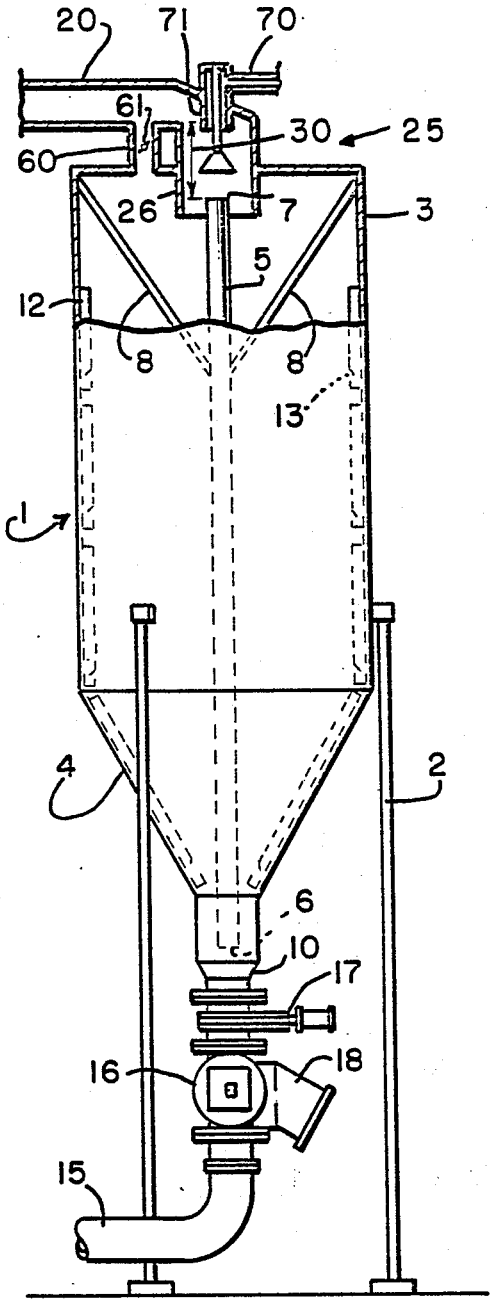
FIG. 1 is an elevation view with parts broken away showing a blender for pelletized material utilizing the fines separation system according to the present invention.

As illustrated in the drawings, the apparatus for separating a fine fraction of material from solid particulate material according to the present invention is used with a blender including a vertically-oriented vessel generally indicated at 1 which may be mounted on suitable support means such as legs 2. The vessel 1 includes an upper-end 3 and a lower conical end 4. A vertically-oriented lift column 5 having a lower material inlet 6 and an upper material outlet 7 is centrally mounted within the vessel by means of bracing 8 shown as angled support rods. As described in the aforesaid U. S. patent application Ser. No. 06/848,005, the vessel may include a seal leg 10 with the inlet opening 6 being positioned within that seal leg.

The vessle also includes a plurality of circumferentially spaced-apart downcomers 12, each having a plurality of longitudinally spaced-apart openings 13 therein for withdrawing material from the various levels in the vessel and allowing it to flow down the downcomer 12 towards the top of the seal leg 10.

The bottom of the vessel is connected by a conduit 15 to a source of gaseous fluid under pressure (not shown). A diverter valve 16 may be mounted in the conduit 15 and a cut-off valve 17 may also be mounted in the conduit 15. The diverter valve 16 serves to allow gasous fluid to flow through the conduit 15 up into the bottom of the vessl and into the vertical lift column 5 through inlet 6 entraining material which may be contained within the seal leg 10 and the vessel 1. As material flows up through the conduit 5, it is discharged through the outlet 7 in a geyser-like manner into the top of the vessel 1. Thus, material which flows down the downcomer 12 into seal leg 10 is lifted up through the column 5 to the top of the vessel to circulate material from the bottom of the vessel and the seal leg 10 into the top of the vessel and blend or mix material within the vessel. When it is desired to withdraw material from the vessel, the diverter valve 16 is moved to a position which closes the gas inlet conduit 15 and opens an outlet 18 and material will flow by gravity out of the vessel 1.

The vessel also includes means 20 defining a vent connected to the top 3 of the vessel for venting gaseous fluid from the vessel and adapted to be connected to a suitable high-efficiency dust collector (not shown) such as a fabric filter dust collector.

Figure 2:
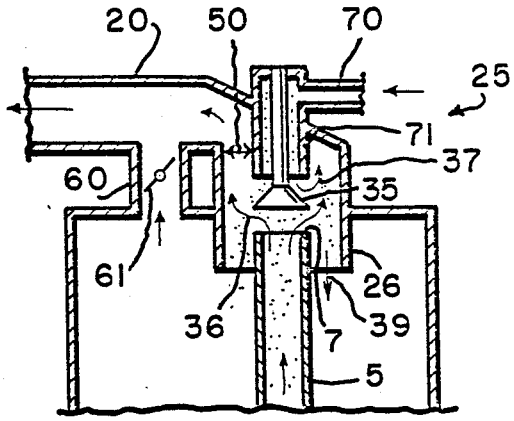
FIG. 2 is a sectional view of the fines separation system of the present invention.

Material to be blended may be supplied to the vessel through a bottom fill such as by pneumatically conveying the material through conduit 15 directly into the lift column 5 (FIG. 2) or through a top fill wherein material is pneumatically conveyed through conduit 70 (FIGS. 1 and 2). The present invention could also be applicable to a mechanical feed where material is supplied to the top of the vessel, but that is not the preferred form.

The present invention includes an apparatus generally indicated at 25 for separating a fine fraction of material from the desired size solid particulate material within the vessel and being supplied to the vessel. This apparatus includes a separator shell 26 which surrounds the outlet 7 of the vertical lift pipe 5. This separator shell extends into the vessel 1 a distance below the outlet 7 of the lift pipe 5 and is flow connected at its top to the event 20. The distance between the top 27 of the lift pipe 5 and the inlet 28 of the vent 20 defines a distance 30 which is referred to as the separation zone (see FIGS. 1 and 3).

Gaseous fluid which flows through the conduit 5 entraining material from the bottom of the vessel will casue the material to cascade out of the outlet 7 in a geyser-like manner within the separation zone 30 in the separator shell 26 and then to fall into the top of the vessel 1. In order to assist the distribution of a material through the separation shell, a distributor 35 is mounted to extend into the separator shell above the outlet 7 of the vertical lift pipe 5. Gaseous fluid under pressure which has entrained material up through the lift pipe 5 is vented out of the vessel through the separator shell 26 to the vent 20. This gaseous fluid flows through the material being discharged from the lift pipe within the separation zone 30 to entrain and convey a fine fraction of material (both smaller than desired and less dense than desired) out of the vessel 1 through vent 20 to a high efficiency dust collector. Thus, the present invention has been desigend so that gaseous fluid flows through the particulate material while it is air borne or dispersed within the separation zone.

As will be known to those skilled in the art, a high velocity gas flow will entrain larger or heavier particles than a lower velocity gas flow. In order to control the particle size and/or density of the fine fraction being entrained out of the vessel, it is necessary to control the velocity of the gaseous fluid passing through the particulate material which is dispersed within the separation zone. Gas velocity can be controlled by controlling the quantity of gas passing through a fixed area or by changing the area through which gas flows or both. For a specific application of the present invention the size of the separtion zone becomes fixed and the cross-sectional area through which the gas flows within the separation zone becomes a 'critical zone'. In the embodiments illustrated in the drawings, the critical zone is designated at 50 and is an annular area between the separator shell 26 and the outer circumference of the distributor member 35 in FIG. 3 or the outer circumference of the material inlet conduit 71 in FIGS. 1 and 2. As the size of this annular area 50 increases. for a given volume of gas, the velocity of that gas will decrease in a manner generally known to those skilled in the art. Therefore for a specific application of the present invention, the separation zone 26 and the critical zone 30 is dimensioned so that the velocity of gaseous fluid flowing through the separation zone is sufficient to entrain and convey the largest desired particle size of the fine fraction to be removed from the vessel while being insufficient to entrain the smallest desired particle size of particulate material to be retained in the vessel.

Since a given blender may be used for a variety of materials and various size or weight (density) particulate material and the size or density of the fine fraction to be removed may vary, but the blender sizing including the size of the separation zone 30 and critical zone 50 once established become fixed, the present invention also provides means for controlling the velocity of gaseous fluid flowing through the separation zone for controlling the particle size of the separated fine fraction of material. In the embodiment illustrated, this is carried out by providing a by-pass conduit 60 extending directly from the top of the vessel 1 to the vent 20 for passing gaseous fluid from the vessel to the vent 20 around the separation zone 30. In order to provide a control, a valve means 61 such as a butterfly valve is positioned in the by-pass 60 for controlling the volume of gaseous fluid which flows therethrough. As the valve 61 is opened, more gaseous fluid will flow from the vessel 1 through by-pass 60 to vent 20. This will decrease the volume of gas flowing through material dispersed in the separation zone. Since the critical zone 50 is fixed in size, a decreased gas volume will result in a decreased gas velocity in the separation zone. This decreased velocity will reduce the particle size and density of the fine fraction of material entrained in the gaseous fluid passing through the separation zone to the vent. Of course, this means that the particle size and/or density returned to the vessel will increase. The opposite is true of the valve 61 is closed to reduce flow through duct 60. Thus, control of gas flow through the by-pass controls the velocity of gas which flows through the separation zone 30 and the critical area 50 and controls the split between the fine fraction removed and the particle retained.

Figure 3:
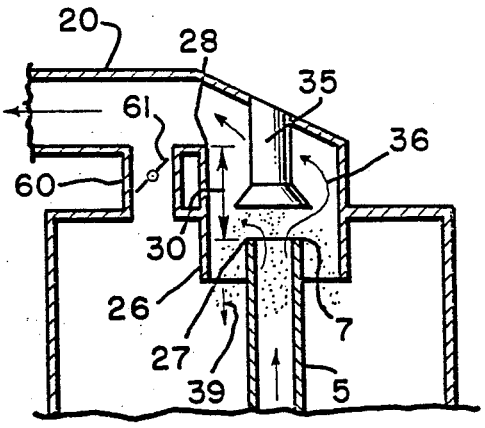
FIG. 3 is a view similar to FIG. 2 showing an alternate embodiment of the present invention.

According to one embodiment of the invention the separation apparatus is capable of being used with a blender having an arrangement for filling the blender from the bottom. In such an instance, material is supplied from a source through the air supply conduit 15 past diverter valve 16 into the bottom of the blender 1 and directly up through the lift column 5 to be discharged into the top of the blender through the outlet 7. In this case the conveying and blending may be done simultaneously as the conveying air entrains material already in the vessel and conveys it up through inlet 6 and lift pipe 5 to cause mixing with new feed. The energy utilized for supplying the particulate material to the blender is utilized for cleaning the material as the conveying air is the air which passes through material in the separation zone. Thus, as the air and entrained material is discharged from the outlet 7 of the lift pipe 5, the fine fraction is air swept or entrained in the conveying and blending air through the separation zone 30 and the critical area 50 to remove the particulate material through vent 20; see arrows 36 designating air flow through the separation zone. This embodiment is illustrated in FIG. 3.

The present invention is also suitable for use for a top filled blender as illustrated in FIGS. 1 and 2. In this case, the material is supplied from a source (not shown) through conduit 70 and an inlet pipe 71 extending into the separator shell 26. In this case, the distributor 35 is mounted within the pipe 71 and the critical zone 50 is defined by the shell 26 and the outside diameter of pipe 71. With a top fill arrangement, material is circulated through the vessel by gaseous fluid under pressure supplied through conduit 15 to entrain material from seal leg 10 up through lift pipe 5. In this embodiment, the material may be supplied through conduit 70 by a pneumatic conveying system and the spent conveying air discharged from inlet pipe 71 (arrow 37) is added to the recirculating air flowing through lift pipe 5 (arrows 36) to define the volume of gas flowing through the separation zone 30 for entraining the fine fraction of material through vent 20 to the high efficiency dust collector. Material of the desired size and density falls back into the vessel (arrow 39). In the embodiment of FIG. 2, both the recirculated material discharged from the lift pipe 5 and the new feed discharged from the feed pipe 71 are dispersed in the separation zone 30 by distributor 35 and the gaseous fluid flowing through the separation zone "cleans" or entrains the fine fraction out of the system.

The control of velocity of gas through the separation zone by the by-pass valve 61 should be apparent to those skilled in the art. As the valve 61 is opened, more gas will flow through the direct by-pass conduit 60 reducing the quantity of gas and thus its velocity through the separation zone. In designing a specific application of the apparatus, it is desirable to initially size the critical zone 50 so that the velocity through that zone and the separation zone 30 is higher than necessary to entrain the anticipated fine fraction. This allows the valve 61 to be utilized to provide control for the system.

From the foregoing, it should be apparent that the objects of this invention have been carried out. An apparatus has been provided which utilizes the energy for supplying the material to the vessel and the blending energy to clean the particulate material being blended by removing an undesired fine fraction of material. The velocity of gas through a separation zone is controlled to thereby control the particle size of the fine fraction being removed.

While the invention has been described utilizing a positive pressurized gas, it should be understood that it is contemplated that gas flow through the separation zone, but it should be understood that the concept will also work if the gas flow is generated by creating a vacuum at the vent point.

It is intended that the foregoing description be merely that of preferred embodiments and that the invention be limited solely by that which is within the scope of the appended claims.

I claim:

1. In a vessel for solid particulate material including a vertically oriented lift pipe for circulating material within the vessel having an inlet near the bottom of the vessel and an outlet near the top of said vessel, means for supplying gaseous fluid to the inlet of the lift pipe for entraining and conveying material in the vessel into the inlet of the lift pipe through the lift pipe to the outlet of the lift pipe for discharge back into the vessel to thereby circulate material within the vessel, means defining a vent for venting gaseous fluid from the vessel, and including apparatus for separating a fine fraction of material from the solid particulate material comprising: means defining a separator shell surrounding the outlet of the lift pipe and defining a separation zone whereby material discharged from the outlet of the lift pipe cascades through the separation zone into the top of the vessel; said separator shell being flow connected to the vent whereby gaseous fluid to be vented from said vessel flows through the material discharged from the lift pipe in said separation zone to said vent for separating a fine fraction of material from the solid particulate material being discharged from the lift pipe by entraining and conveying said fine fraction through the vent out of the vessel; said separation zone being dimensioned so that the velocity of gaseous fluid flowing through the separation zone is sufficient to entrain and convey the fine fraction to be separated while being insufficient to entrain the particulate material to be retained in said vessel, a by-pass conduit extending from said vessel to said vent for venting gaseous fluid from said vessel to said vent around said separation zone; and valve means mounted in said by-pass conduit for controlling the quantity of gaseous fluid which flows therethrough for controlling the velocity of gaseous fluid which flows through the separation zone for controlling the split between the fine fraction conveyed through said vent and the particulate material retained in the vessel.

2. In a vessel for solid particulate material according to claim 1 wherein said apparatus for separating a fine fraction further comprises a distributor mounted in said separator shell above the outlet of the vertical lift pipe for dispersing material discharged from the outlet of the lift pipe into the flow of gaseous fluid through said separation zone.

3. In a vessel for solid particulate material according to claim 2 wherein the distance between said distributor and the separator shell defines an area for determining the velocity of gaseous fluid which flows through the separation zone.

4. In a vessel for solid particulate material according to claim 1 wherein said vessel includes a material inlet conduit extending into said separator shell and adapted to be connected to a means for supplying particulate material to the vessel.

5. In a vessel for solid particulate material according to claim 4 wherein a distributor is mounted in said separation shell above said vertical lift pipe and below the material inlet conduit.

6. In a vessel for solid particulate material according to claim 5 wherein the distance between said material inlet conduit and said separator shell defines an area for determining the velocity of gaseous fluid which flows through the separation zone.

* * * * *